US010989202B2

(12) United States Patent
Petry

(10) Patent No.: US 10,989,202 B2
(45) Date of Patent: Apr. 27, 2021

(54) BACKFEED STAGE AND RADIAL TURBO FLUID ENERGY MACHINE

(71) Applicant: Siemens Aktiengesellschaft, Munich (DE)

(72) Inventor: Nico Petry, Oberhausen (DE)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 67 days.

(21) Appl. No.: 16/488,876

(22) PCT Filed: Feb. 6, 2018

(86) PCT No.: PCT/EP2018/052852
§ 371 (c)(1),
(2) Date: Aug. 26, 2019

(87) PCT Pub. No.: WO2018/166716
PCT Pub. Date: Sep. 20, 2018

(65) Prior Publication Data

US 2020/0025205 A1 Jan. 23, 2020

(30) Foreign Application Priority Data

Mar. 15, 2017 (EP) ..... 17161002

(51) Int. Cl.
*F04D 29/28* (2006.01)
*F04D 17/12* (2006.01)
(Continued)

(52) U.S. Cl.
CPC ..... *F04D 17/122* (2013.01); *F04D 29/284* (2013.01); *F04D 29/4213* (2013.01); *F04D 29/444* (2013.01)

(58) Field of Classification Search
CPC .... F04D 17/122; F04D 29/284; F04D 29/444; F04D 29/4213
See application file for complete search history.

(56) References Cited

U.S. PATENT DOCUMENTS 2,300,766 A 11/1942 Adolf et al.
6,742,507 B2 * 6/2004 Keefer ..... F02M 25/12 123/585
(Continued)

FOREIGN PATENT DOCUMENTS

CN 102678590 A 9/2012
CN 103154466 A 6/2013
(Continued)

OTHER PUBLICATIONS

PCT International Search Report and Written Opinion of International Searching Authority dated Mar. 5, 2018 corresponding to PCT International Application No. PCT/EP2018/052852 filed Jun. 2, 2018.

*Primary Examiner* — Michael Lebentritt

(57) ABSTRACT

A backfeed stage of a radial turbo fluid energy machine having a backfeed channel extending annularly about an axis and four sections adjacent in the flow direction through which process fluid flows. A first section conducts the process fluid radially outward; a second section deflects the process fluid from radially outward to radially inward; a third section conducts the process fluid radially inward; a fourth section redirects the process fluid in the axial direction; the third section has first guide vanes defining flow channels of the backfeed channel in relation to each other in the circumferential direction; the backfeed stage has second guide vanes downstream of the first guide vanes defining the flow channels of the backfeed channel in relation to each other in the circumferential direction. The first guide vanes are arranged only in the third section, the second guide vanes are arranged only in the fourth section.

10 Claims, 3 Drawing Sheets

(51) Int. Cl.
*F04D 29/42* (2006.01)
*F04D 29/44* (2006.01)

(56) References Cited

U.S. PATENT DOCUMENTS

| | | | |
|---|---|---|---|
| 2013/0152582 A1 | 6/2013 | Anschel et al. | |
| 2019/0055960 A1* | 2/2019 | Hermes | F04D 29/444 |

FOREIGN PATENT DOCUMENTS

| | | | |
|---|---|---|---|
| CN | 205654604 | U | 10/2016 |
| DE | 723824 | C | 8/1942 |
| JP | H0244516 | A | 2/1990 |
| JP | H11173299 | A | 6/1999 |
| JP | 2001200797 | A | 7/2001 |
| JP | 2009264305 | A | 11/2009 |
| JP | 2010185361 | A | 8/2010 |
| WO | 2015072231 | A1 | 5/2015 |

* cited by examiner

BACKFEED STAGE AND RADIAL TURBO FLUID ENERGY MACHINE

CROSS REFERENCE TO RELATED APPLICATIONS

This application is the US National Stage of International Application No. PCT/EP2018/052852 filed Feb. 6, 2018, and claims the benefit thereof. The International Application claims the benefit of European Application No. EP17161002 filed Mar. 15, 2017. All of the applications are incorporated by reference herein in their entirety.

FIELD OF INVENTION

The invention concerns a backfeed stage of a radial turbo fluid energy machine, in particular of a radial turbo compressor, for deflecting a flow direction of a process fluid flowing out of an impeller rotating about an axis from radially outward to radially inward, comprising a backfeed channel which extends annularly about the axis and has four portions mutually adjacent in the flow direction, wherein a first portion is designed to conduct the process fluid radially outward, wherein a second portion is designed to deflect the process fluid from radially outward to radially inward, wherein a third portion is designed to conduct the process fluid radially inward, wherein a fourth portion is designed to divert the process fluid in the axial direction, wherein the third portion has first guide vanes which define flow channels of the backfeed channel relative to each other in the circumferential direction, wherein the backfeed stage has second guide vanes which are arranged downstream of the first guide vanes and define the flow channels of the backfeed channel relative to each other in the circumferential direction, wherein the first guide vanes and the second guide vanes are connected fixedly and immovably to a stator.

BACKGROUND OF INVENTION

In a radial compressor (see FIG. 1), the fluid to be compressed leaves an impeller rotating about an axis in the radial direction with a significant speed component in the circumferential direction (swirl). The static, aerodynamically active components downstream in the flow direction have the task of converting the kinetic energy supplied in the impeller into pressure. In a multistage single-shaft compressor as known for example from JP000244516, the fluid must also be conducted to the next downstream impeller. Furthermore, the swirl must be extracted from the flow so that the latter contacts the next impeller largely swirl-free. This object is achieved by a so-called backfeed stage comprising a first portion which guides the process fluid radially outward, a second portion which corresponds substantially to an 180° bend, and a third portion for conducting the process fluid radially inward to the inlet into the next downstream impeller. A fourth portion defines a deflection of the process fluid from the radially inwardly directed flow into the axial direction toward the impeller inlet of the downstream impeller.

An at least partially generic backfeed vane set is already known from JP11173299-A.

Different radial guide vane extents or profile chord lengths of adjacent guide vanes of generic backfeed stages are already known from DE723824.

Publications JP2009/264305 A and U.S. Pat. No. 2,300,766 A disclose generic backfeed stages with two-stage guide vane sets, wherein the second guide vane row is in each case formed so as to be rotationally adjustable in a complex fashion.

WO 2015/072231 A1 describes an arrangement of two rows of guide vanes in the backfeed stage, wherein the guide vanes have a three-dimensional, non-cylindrical design.

JP2001/200797 A discloses an arrangement of two guide vane rows in the backfeed stage.

The arrangements known in the prior art are not compact, i.e. they require a comparatively large space, and the throughflow is subject to relatively high losses. Backfeed stages of the prior art are also complex to manufacture and install.

SUMMARY OF INVENTION

Starting from the problem and disadvantages of the prior art, the object of the invention is to refine a backfeed stage of the type defined initially such that a more compact backfeed stage produces a flow with lower loss, which in particular has little swirl and little eddying.

To achieve the object according to the invention, a backfeed stage of the type defined initially is proposed with the additional features of the characteristic part of the independent claim. The invention furthermore proposes a radial turbo fluid energy machine with such a backfeed stage.

In technical language, it is usual only to describe the combination of the second portion with the third portion as the backfeed stage, and to define the first portion as a diffuser present upstream in the flow direction. The fourth portion is also not always considered part of the backfeed stage. The terminology of this document describes the four portions arranged successively in the flow direction (S1, S2, S3; S4; see figures) as the backfeed stage. It must be noted here that the first portion may be freely designed in the context of the invention, so that the first portion may be configured, with or without vanes, for example to be widening, constant or tapering in meridional section in the flow direction.

In the context of the invention, geometric expressions, such as axial, tangential, radial or circumferential, always relate to a rotation axis of an impeller of a radial turbo fluid energy machine unless specified otherwise in direct connection therewith. The backfeed stage according to the invention has a clear connection with such an impeller, since the backfeed stage extends around the impeller in the circumferential direction downstream of the impeller outlet in a radial turbo compressor. Usually, the backfeed stage is formed rotationally symmetrical to the axis, at least with regard to the aerodynamically relevant aspects of the limits of the annular chamber of the invention.

Because the first guide vanes and second guide vanes are arranged successively in the flow direction, the backfeed stage according to the invention takes up less space than a backfeed stage which does not have the two guide vane stages arranged successively. Orientation of the flow onto the inlet of the next downstream impeller is aerodynamically more efficient because of the stepped guide vane design.

Aerodynamically, the invention allows a division of the tasks between the two rows of guide vanes, the first guide vanes and the second guide vanes, which is particularly efficient. The first guide vanes substantially deflect the flow and the second guide vanes substantially break up the turbulence forming in the first guide vanes. This leads to a more homogenous inflow to the next impeller, and to an inflow to the next impeller which generally has less swirl.

The arrangement of the first guide vanes and the second guide vanes exclusively in the third portion of the backfeed stage ensures an aerodynamically advantageous preparation of the process fluid for the downstream impeller after the 90° deflection. It has been found that the flow guidance in the third portion, divided into the two guide stages, works particularly efficiently with a swirl-free orientation of the process fluid. In addition, the arrangement of the guide vanes exclusively in the third portion is particularly beneficial for manufacture and assembly. The arrangement in the third portion advantageously allows a robust fixing of the diaphragm to the vane base, and in addition, because of the relatively simple geometry of the radial backfeed in the region of the third portion, is particularly suitable for installation and manufacture of the two guide vane rows. The teaching of the invention lies in particular in that an arrangement of guide vanes in adjacent regions amplifies the tendency toward undesirable secondary flows due to the complexity of the further deflection of the process fluid. The multiple task division according to the invention between several radial deflections (180°, 90° bends), the elimination of swirl (first guide vanes), and the break-up of eddies forming in the first guide vanes (by means of the second guide vanes) is aerodynamically particularly efficient. Because the second guide vanes are arranged exclusively in the third portion of the backfeed stage, any eddies are efficiently broken up and no or almost no new eddies are formed. In this way, the flow into the fourth portion of the backfeed stage is largely swirl-free and eddy-free, and at this point it can be deflected in the axial direction to enter the downstream impeller without being influenced by other aerodynamic measures.

An advantageous refinement of the invention proposes that an outlet edge diameter of the first guide vanes lies in a ratio to an inlet edge diameter of the first guide vanes between $0.5*D2<D3<0.68*D2$, with:

D2: inlet edge diameter of the first guide vanes,

D3: outlet edge diameter of the first guide vanes.

This arrangement has proved particularly favorable for achieving an absence of swirl and eddying at the outlet from the backfeed stage. Another advantageous refinement for eliminating eddying and swirl provides that the first guide vanes have a metal outlet angle to the radial direction with:

$-5°<L1EA<5°$, with:

L1EA: metal outlet angle of the first guide vanes (L1) to the radial direction.

The second guide vanes, according to a further advantageous refinement, may be arranged such that an inlet edge diameter of the second guide vanes lies in a ratio to an outlet edge diameter of the first guide vanes between $0.9*D3<D4<D3$, with:

D3: outlet edge diameter of the first guide vanes,

D4: inlet edge diameter of the second guide vanes.

Another advantageous refinement of the invention proposes that a vane overlap of guide vanes is defined as a quotient of a mean profile chord length and a mean arc length distance in the circumferential direction of mutually adjacent vanes, wherein for the second guide vanes an overlap applies of $0.8<RAS/CDT<1.2$, with:

RAS: profile chord length

CDT: arc length distance.

In this context, it is particularly useful if the backfeed stage has the same number of first guide vanes and second guide vanes.

So that the second guide vanes work particularly efficiently as eddy-breakers, according to an advantageous refinement of the invention, it is suitable if the second guide vanes have a difference between a mean metal inlet angle and mean metal outlet angle for which:

$-5°<DL2A<5°$, with:

DL2A: difference between mean metal inlet angle and mean metal outlet angle.

Particularly, the difference between the mean metal inlet angle and the mean metal outlet angle is zero. In addition, it is also advantageous if the first guide vanes and/or the second guide vanes are designed to be cylindrical.

Another advantageous refinement of the invention provides that precisely one second guide vane is arranged downstream in the circumferential direction between the two nearest first guide vanes.

A second guide vane stage offset in the circumferential direction, or the arrangement of the second guide vanes in the circumferential direction asymmetrically to the outlet edges of the first guide vanes, leads to a reduction in aerodynamic losses of the process fluid on flow through the backfeed stage.

The reorientation and deflection of the process fluid downstream of the outlet from an impeller to the inlet of the next downstream impeller, according to the invention, has particularly low losses and takes up little space. The arc length, which characterizes the distance between the two outlet edges of adjacent first guide vanes in the circumferential direction, is divided by the ray through the inlet edge of the second guide vanes arranged in the circumferential direction between the two first guide vanes, into a pressure-side portion and a suction-side portion.

A particularly advantageous refinement of the invention provides that the second guide vanes are designed and arranged such that the second guide vane, arranged downstream between the two first guide vanes, is arranged in the circumferential direction closer to the suction side of the adjacent first guide vane than to the pressure side of the other adjacent first guide vane.

It has been found that dividing the arc length, which characterizes the distance between the two outlet edges of adjacent first guide vanes in the circumferential direction, is particularly advantageous if the ratio of the suction-side portion to the total arc length is between 0.4-0.6 ($0.4<SSD/BLD<0.6$). This characteristic offset toward the suction side of the first guide vane, which defines the flow channel in the circumferential direction, leads to a turbulence-free through-flow with less detachment, which is particularly low loss.

BRIEF DESCRIPTION OF THE DRAWINGS

The invention is now described in more detail below with reference to a particular exemplary embodiment shown in the drawings. The drawings show.

DETAILED DESCRIPTION OF INVENTION

Figure 1:
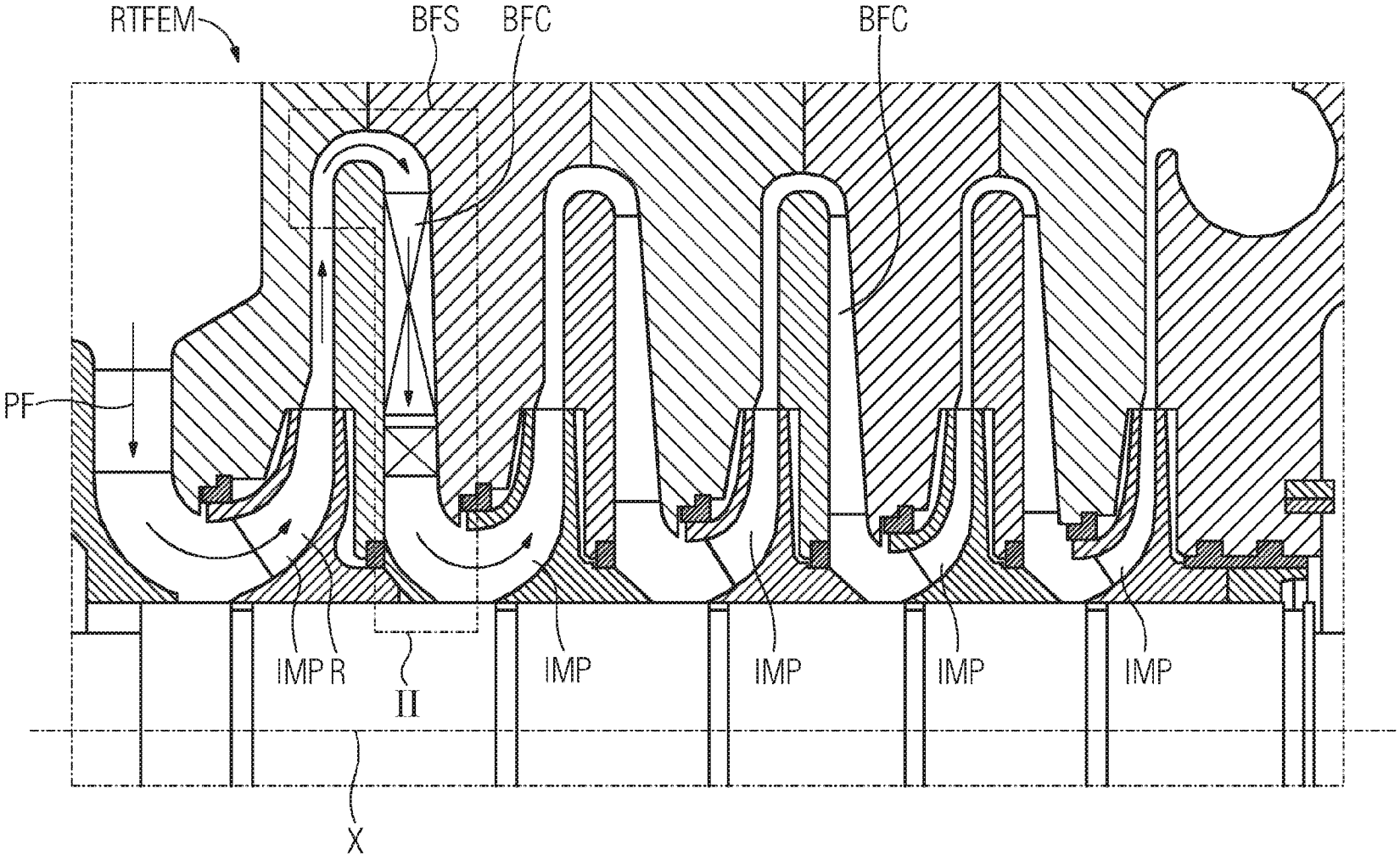
FIG. 1 in diagrammatic depiction, a longitudinal section through the flow channel of the radial turbo fluid energy machine, using the example of a single shaft compressor, FIG. 2 a detail from FIG. 1 marked II in FIG. 1, FIG. 3 a section through a third portion of the backfeed stage according to the section indicated with III-III in FIG. 2, in a radial plane at the axial position of the third portion.

FIG. 1 shows a diagrammatic depiction of a longitudinal section of the radial turbo fluid energy machine RTFEM in an extract of a flow channel for a process fluid PF. The extract shows five impellers IMP which, as part of a rotor R, rotate about an axis X in operation.

All references in this description to axial, radial, tangential or circumferential relate to this axis X. The impellers IMP each draw in the process fluid PF substantially axially and deliver this, accelerated, radially outward. After emerging from the impeller IMP, the process fluid PF enters a backfeed stage BFS comprising a backfeed channel BFC.

Figure 2:
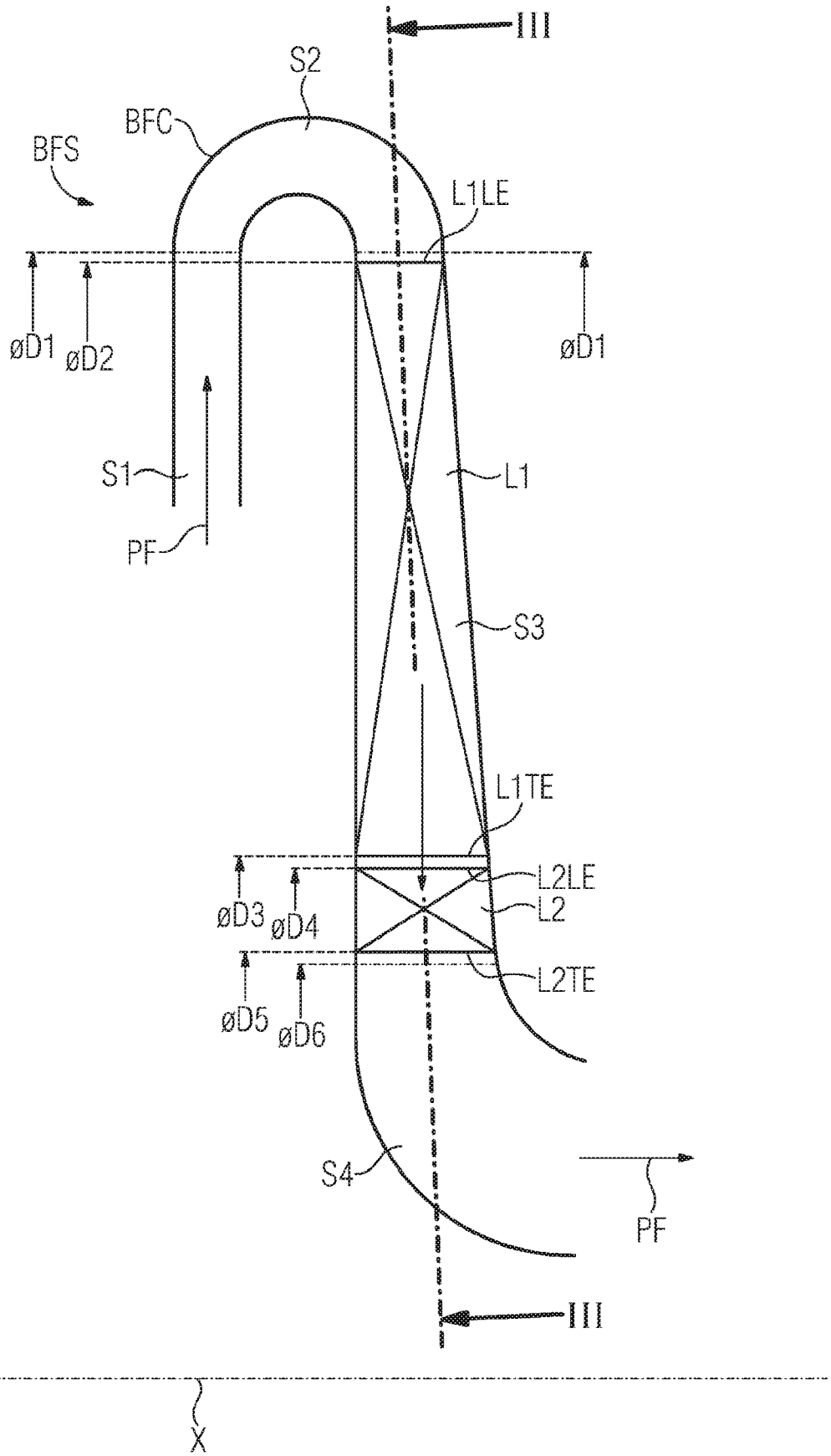

FIG. 2 shows the backfeed stage BFS or backfeed channel BFC in detail. From the impeller IMP, the process fluid PF enters a first portion S1 of the backfeed channel which is designed to conduct the process fluid PF radially outwardly. In the downstream second portion S2, the process fluid PF is deflected from a flow direction toward the radial outside into a flow direction FD toward the radial inside. In the following portion S3, the process fluid PF is guided radially inwardly and then conducted axially toward the next impeller IMP. The process fluid PF is deflected in the second portion S2 substantially in the form of an 180° bend. The deflection from a radially inward flow direction FD in the third portion S3 into the axial flow direction FD takes place substantially in a 90° bend which constitutes a fourth portion S4.

First guide vanes L1 and second guide vanes L2 are arranged only in the third portion S3. The first guide vanes have an inlet edge L1LE and an outlet edge L1TE. The second guide vanes L2 have an inlet edge L2LE and an outlet edge L2TE. In this exemplary embodiment, the inlet edge L2LE of the second guide vane L2 sits downstream in a radial portion RAD and on a smaller radius than the outlet edges L1TE of the first guide vanes L1—this arrangement is advantageous according to the invention. However, the scope of the invention also includes embodiments in which this radial portion RAD is zero or the inlet edges L2LE are situated in the radial region of the first guide vanes L1.

The guide vanes L1, L2 define a flow channel FC in the circumferential direction between two first guide vanes L1, by a pressure side PSL1 of a first guide vane L1 and a suction side SSL1 of another first guide vane L1. In a plane extending radially (drawing plane of FIG. 3), in the region of the axial extent of the third portion S3, a connecting line CLTE can always be indicated by two outlet edges L1TE of adjacent first guide vanes L1. This connecting line CLTE extends with a radius of curvature which corresponds to the distance radius from the axis X. An arc length BLD of this connecting line CLTE between the two outlet edges L1TE of the adjacent first guide vanes L1 is divided non-centrally by a radial ray RS through the inlet edge L2LE of the second guide vane arranged between the two first guide vanes L1 in the circumferential direction. The first part portion of this connecting line CLTE is situated between the inlet edge L2LE of the second guide vane L2 and the outlet edge L1TE of the first guide vane L1 which delimits the respective flow channel FC with its suction side SSB1. This suction-side portion SSD is smaller than the corresponding adjacent pressure-side portion PSD. The ratio of the suction-side portion SSD to the entire arc length BLD of the connecting line CLTE between the two outlet edges L1TE of the first guide vanes L1 is between 0.4-0.6 ($0.4<SSD/BLD<0.6$). This type of uneven division of the flow channel FC between the two first guide vanes L1 by means of the following guide vane L2 leads to a particularly advantageous, low-loss flow through the third portion S3.

Figure 3:
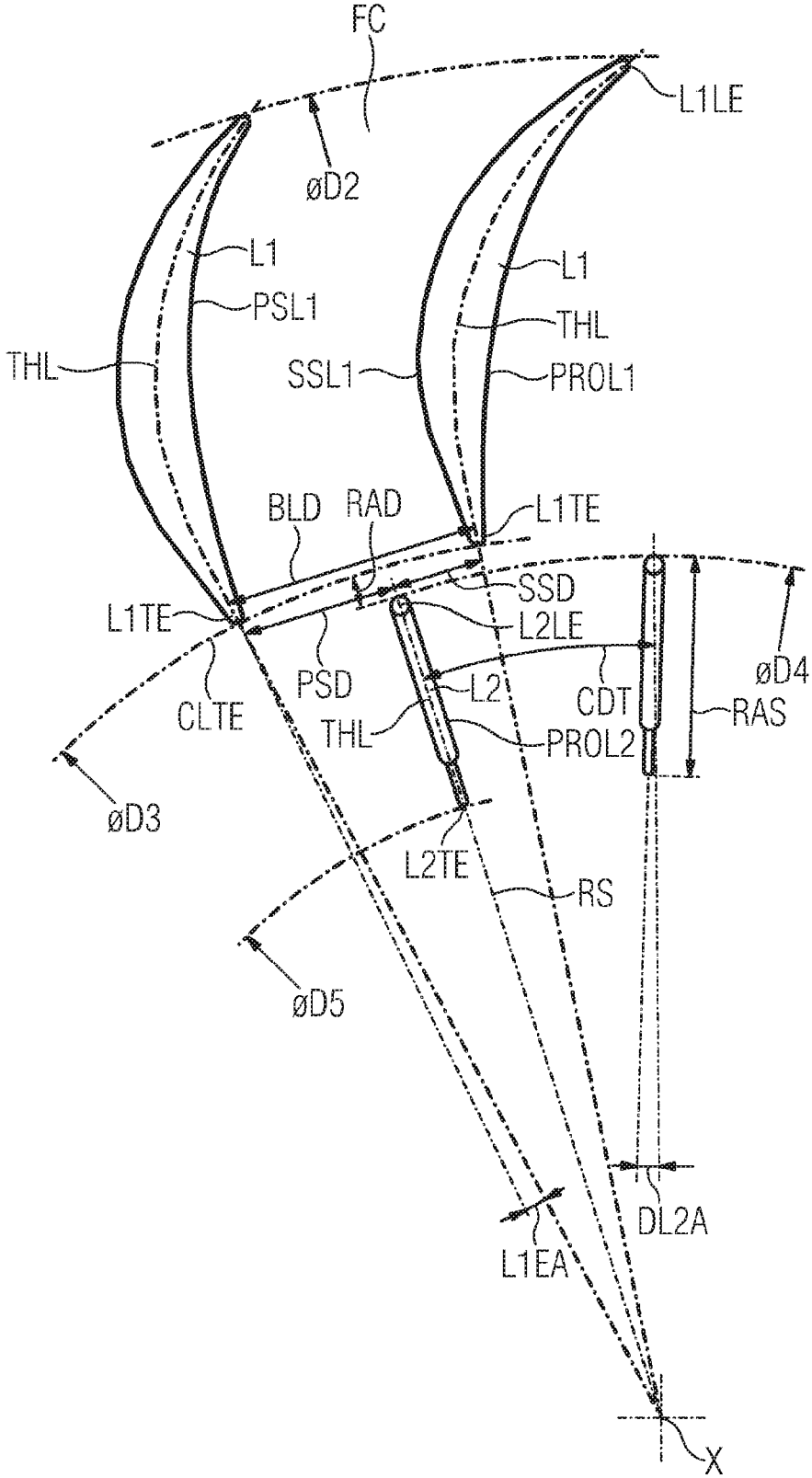

FIGS. 2 and 3 show different diameters for different positions of the backfeed stage BFS. The first portion S1 extends up to a diameter D0. The second portion S2 extends in the flow direction up to a diameter D1. These two diameters are almost identical in this exemplary embodiment. The inlet edge L1LE of the first guide vanes L1 lies on diameter D2. The outlet edge L1TE of the first guide vanes L1 lies on diameter D3. The third portion S3 extends from diameter D1 to diameter D6. The inlet edges L2LE of the second guide vanes L2 each lie on a diameter D4. The outlet edges L2TE of the second guide vanes L2 each lie on a diameter D5. The fourth portion S4 adjoining the third portion S3 begins at diameter D6.

The invention claimed is:

1. A backfeed stage of a radial turbo fluid energy machine or a radial turbo compressor, for deflecting a flow direction of a process fluid flowing out of an impeller rotating about an axis from radially outward to radially inward, comprising:

a backfeed channel which extends annularly about the axis and which has four portions adjacent in the flow direction, through which the process fluid can flow, wherein a first portion is designed to conduct the process fluid radially outward, wherein a second portion is designed to deflect the process fluid from radially outward to radially inward, wherein a third portion is designed to conduct the process fluid radially inward, wherein a fourth portion is designed to divert the process fluid in an axial direction, wherein the third portion has first guide vanes which define flow channels of the backfeed channel relative to each other in a circumferential direction, wherein the backfeed stage has second guide vanes which are arranged downstream of the first guide vanes and define the flow channels of the backfeed channel relative to each other in the circumferential direction, wherein the first guide vanes are arranged exclusively in the third portion, wherein the second guide vanes are arranged exclusively in the fourth portion, wherein the first guide vanes and the second guide vanes are connected fixedly and immovably to a stator, wherein an outlet edge diameter (D3) of the first guide vanes lies in a ratio to an inlet edge diameter (D2) of the first guide vanes between $0.5*D2<D3<0.68*D2$, with:

D2: inlet edge diameter of the first guide vanes,

D3: outlet edge diameter of the first guide vanes.

2. The backfeed stage as claimed in claim 1, wherein the first guide vanes have a metal outlet angle (L1EA) to the radial direction with:

$-5°<L1EA<5°$, with:

L1EA: metal outlet angle of the first guide vanes to the radial direction.

3. The backfeed stage as claimed in claim 1, wherein an inlet edge diameter (D4) of the second guide vanes lies in a ratio to an outlet edge diameter (D3) of the first guide vanes between $0.9*D3<D4<D3$, with:

D3: outlet edge diameter of the first guide vanes,

D4: inlet edge diameter of the second guide vanes.

4. The backfeed stage as claimed in claim 1, wherein a vane overlap of guide vanes is defined as a quotient of a mean profile chord length (RAS) and a mean arc length distance (CDT) in the circumferential direction of mutually adjacent vanes, wherein for the second guide vanes an overlap applies of $0.8<RAS/CDT<1.2$, with:

RAS: mean profile chord length

CDT: mean arc length distance.

5. The backfeed stage as claimed in claim 1, wherein the second guide vanes have a difference (DL2A) between a mean metal inlet angle (L2IA) and mean metal outlet angle (L2EA) for which:

$-5° < DL2A < 5°$, with:

DL2A: difference between mean metal inlet angle (L2IA) and mean metal outlet angle (L2EA).

6. The backfeed stage as claimed in claim 1, wherein the backfeed stage has equal numbers of first guide vanes and second guide vanes.

7. The backfeed stage as claimed in claim 1, wherein precisely one second guide vane is arranged downstream in the circumferential direction between the two first guide vanes.

8. The backfeed stage as claimed in claim 7, wherein the first guide vanes each have a concave pressure side and a convex suction side, and each flow channel in the region of the first guide vanes is defined by a pressure side of a first guide vane and a suction side of another adjacent first guide vane, wherein the second guide vane arranged downstream between the two first guide vanes is arranged closer in the circumferential direction to the suction side of the other adjacent first guide vane.

9. The backfeed stage as claimed in claim 1, wherein an arc length in the circumferential direction of the distance (BLD) between the two outlet edges of adjacent first guide vanes is divided by the radial ray through the inlet edge of the second guide vane arranged between the two first guide vanes in the circumferential direction, into a pressure-side portion and a suction-side portion (SSD), wherein:

$0.4 < SSD/BLD < 0.6$, with:

SSD: suction-side portion

BLD: arc length in the circumferential direction of the distance.

10. A radial turbo fluid energy machine, comprising:

a backfeed stage as claimed in claim 1.

* * * * *